United States Patent [19]

Linstromberg

[11] Patent Number: 4,651,789

[45] Date of Patent: Mar. 24, 1987

[54] SNAP-ON INTERLOCK FOR WATER DISPENSER

[75] Inventor: William J. Linstromberg, Lincoln Township, Berrien County, Mich.

[73] Assignee: Whirlpool Corporation, Benton Harbor, Mich.

[21] Appl. No.: 784,328

[22] Filed: Oct. 3, 1985

[51] Int. Cl.[4] ..... B65B 3/04

[52] U.S. Cl. ..... 141/360; 251/93; 141/392

[58] Field of Search ..... 251/93; 141/360, 361, 141/362, 392

[56] References Cited

U.S. PATENT DOCUMENTS

| | | | |
|---|---|---|---|
| 2,670,239 | 2/1954 | Ditch | 251/93 |
| 2,845,964 | 8/1958 | Harland | 141/104 |
| 3,318,492 | 5/1967 | Haas | 251/93 |
| 3,934,757 | 12/1974 | Malek et al. | 222/763 |
| 4,102,660 | 8/1976 | Beckett et al. | 222/311 |
| 4,138,092 | 3/1977 | Apellaniz | 251/325 |
| 4,252,160 | 5/1979 | Numbers | 141/98 |

*Primary Examiner*—Houston S. Bell, Jr.
*Attorney, Agent, or Firm*—Frederick S. Burkhart

[57] ABSTRACT

A water dispenser having an actuator that is displaced in order to dispense water from an overhead spout and an interlock member that prevents the actuator from being displaced an amount sufficient to dispense water unless a drinking glass is used to move the actuator. The interlock member surrounds the actuator and is slidably movable along the actuator from a first rest position, to a second disengaged position by the lip of a glass pressed against the actuator. In the first position, the interlock member will strike a stationary abutment to prevent the actuator from being displaced. In the disengaged position, the interlock member will not strike the abutment and the actuator can be displaced to dispense water.

16 Claims, 4 Drawing Figures

SNAP-ON INTERLOCK FOR WATER DISPENSER

BACKGROUND OF THE INVENTION

Field of the Invention

This invention relates to a water dispenser and more particularly to a water dispenser mounted on the exterior of a refrigerator door for dispensing chilled water.

SUMMARY OF THE INVENTION

Manufacturers of refrigerators have offered, as a feature of their product, a water dispenser mounted to the exterior of the refrigerator door. Such a water dispenser is usually combined with a water reservoir, remotely located within the refrigerated compartment, to provide ready access to chilled water without the need to open the refrigerator door. The water dispenser is provided at a height about midway on the refrigerator door to allow use of the dispenser by various size persons.

One problem presented by the convenient location of the water dispenser is the possibility of inadvertent operation of the dispenser by a person accidentally bumping into the actuator of the dispenser. Further, such a water dispenser is often located closely adjacent an ice dispenser mounted within a common housing on the exterior of the refrigerator door and operation of the ice dispenser can sometimes result in the user's hand inadvertently operating the water dispenser. This inadvertent operation not only can result in spilling of water on the person's clothing, but can also cause a water puddle on the floor.

Various attempts have been made at providing interlock devices for preventing inadvertent operation of liquid dispensers. These attempts, however, have resulted in devices that are complicated to build and install and that make the dispenser more difficult for the consumer to use. The present invention provides an effective interlock means for a water dispenser while avoiding the problems of the prior art devices. In the present invention a water dispenser is provided having an actuator that must be displaced in order to dispense water from a spout located above the actuator and an interlock member slidably mounted to the actuator. The interlock member normally assumes a position on the actuator that will interfere with a stationary abutment to prevent the actuator from being displaced without a drinking glass being utilized to operate the actuator. When, however, a drinking glass or other suitable receptacle is pressed against the dispenser actuator, the force of the glass against the actuator slides the interlock member to a disengaged position free of interference with the abutment so that the actuator can be displaced sufficiently to operate the dispenser.

In the preferred embodiment the actuator is rotatably mounted and the interlock member is a sleeve that is slidably mounted to, and surrounds, the actuator. The interlock member is normally gravity biased to a downward position on the actuator where it will strike a stationary abutment behind the actuator unless slidably moved upwardly by the lip of a drinking glass. The interlock member has a clasp in its peripheral wall that can be opened, and the peripheral wall expanded, to allow the interlock member to be mounted to the actuator of an existing water dispenser as a field installation. The interlock member additionally has inwardly projecting fingers that contact the actuator to enhance the slidability of the member and properly space its peripheral wall from the surface of the actuator.

The present invention has the advantage of preventing improper operation of the water dispenser while not interfering with the operation of the dispenser by a drinking glass or other suitable receptacle. Conveniently, the operation of the dispenser actuator by a drinking glass automatically moves the interlock member to a disengaged position wherein the dispenser will operate. Thus the person operating the dispenser does not have to consciously perform an extra step of disengaging the interlock means in order to operate the dispenser. As a further advantage in the preferred embodiment, the interlock member is easy to manufacture and can be mounted to or removed from a water dispenser without the need for tools and without having to disassemble the other parts of the water dispenser.

DESCRIPTION OF THE PREFERRED EMBODIMENT

Figure 1:
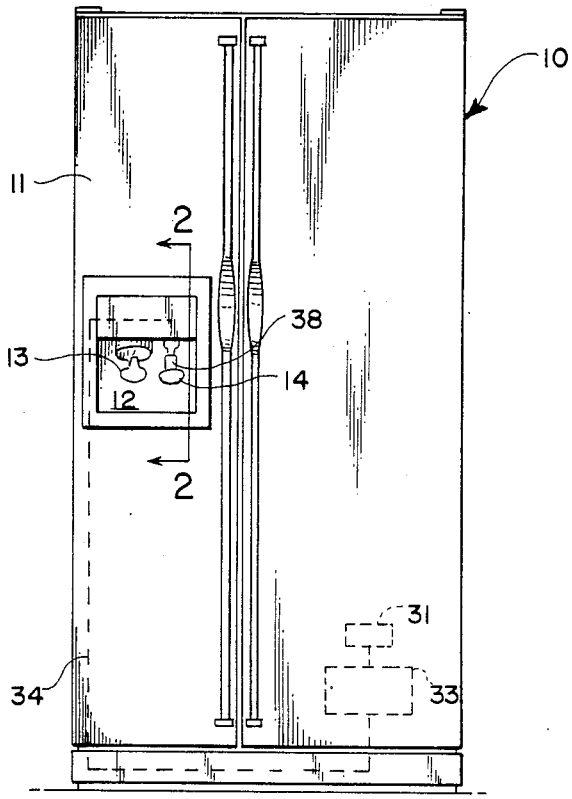
FIG. 1 is the front view of a refrigerator having the improved water dispenser according to the present invention.

Referring to FIG. 1 a refrigerator 10 is provided with a door 11 for gaining access to a below freezing compartment (not shown). Located centrally on the outer face of door 11 is an outwardly opening housing 12 in which are mounted an ice dispenser 13 and water dispenser 14.

Figure 2:
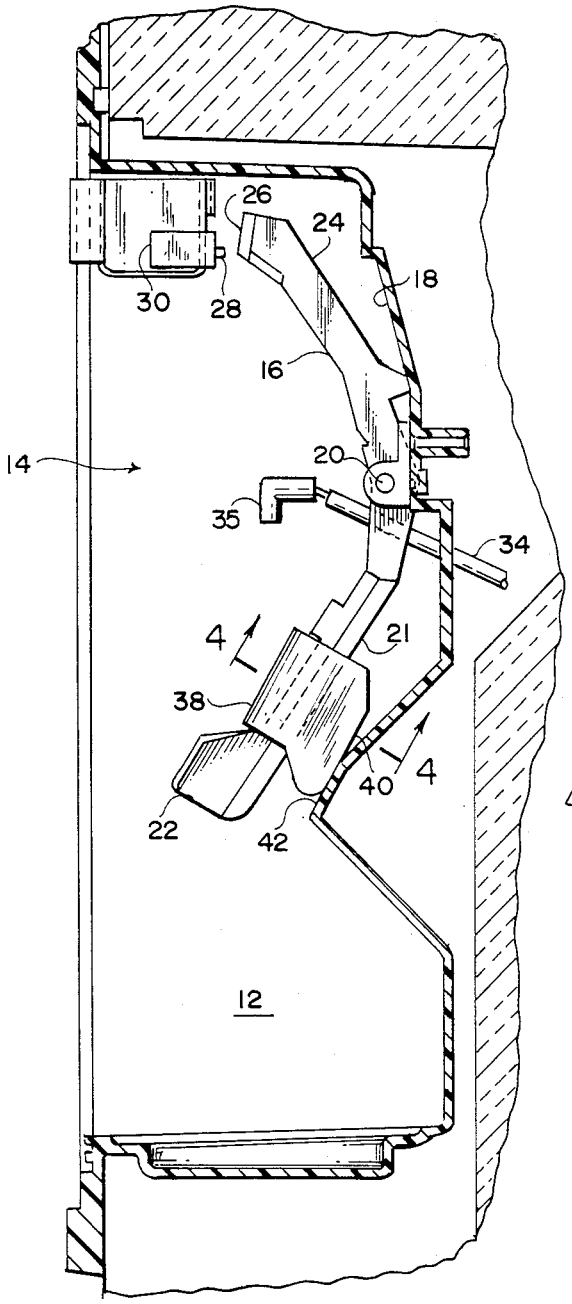
FIG. 2 is a side view of the water dispenser according to the present invention taken along the line 2—2 of FIG. 1.
Figure 3:
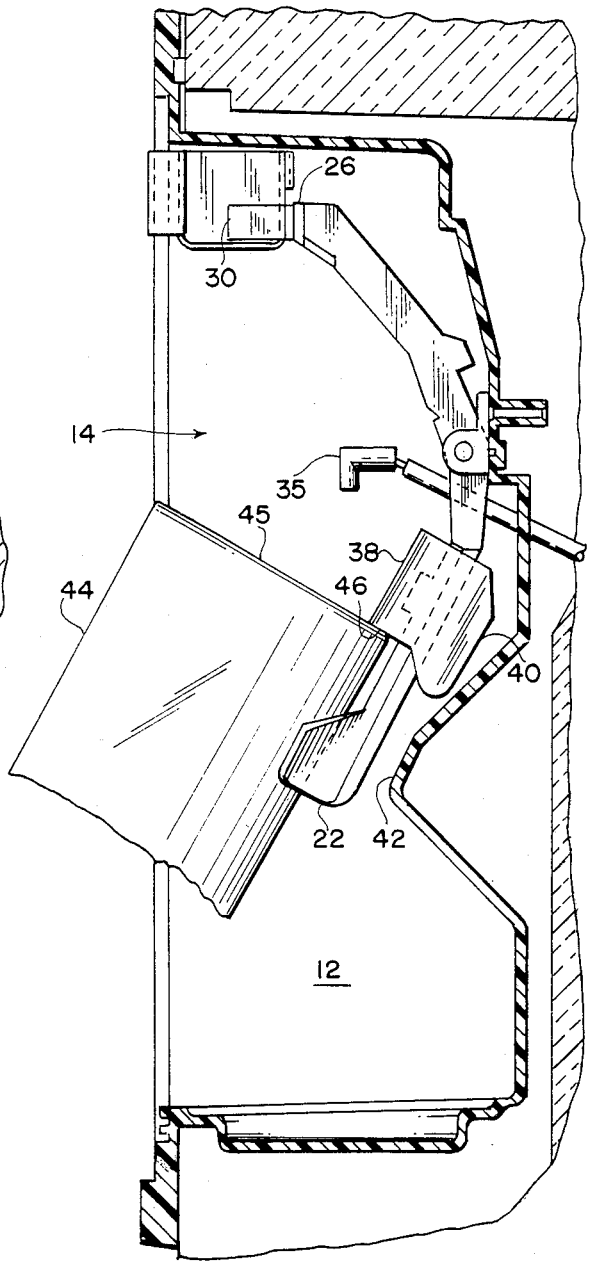
FIG. 3 is the same view as FIG. 2 but showing the water dispenser properly actuated by a drinking glass.

As shown in FIG. 2 water dispenser 14 has an actuator 16 which is pivotally attached to a back surface 18 of housing 12 by a pin 20. An upper extension 24 of dispenser actuator 16 terminates in a pad 26. A dispensing switch 30 is mounted with a push button type operator 28 in alignment with pad 26 so that when dispenser actuator 16 is rotated counterclockwise around pin 20, pad 26 will actuate operator 28, as seen in FIG. 3. A torsion spring (not shown) associated with pin 20 biases actuator 16 to the position shown in FIG. 2. Thus after the actuator is rotated to the position shown in FIG. 3, it will subsequently return to the position shown in FIG. 2.

Operation of switch 30 completes an electrical circuit between a source of power and a solenoid operated valve 31 (FIG. 1) connected to a water supply. Solenoid valve 31 is also connected to a water reservoir 33 which is connected to a water spout 35 by interconnecting tube 34. Thus, when valve 31 is opened pressurizing reservoir 33, water is caused to be delivered to water spout 35.

A lower extension 21 of operator 16 terminates in a cradle shaped glass receiving portion 22. As illustrated in FIG. 3, glass receiving portion 22 is configured to allow a drinking glass to be conveniently pressed against the dispenser actuator, thus rotating the actuator to operate switch 30 and dispense water from spout 35, located above glass receiving portion 22, into the glass.

To prevent inadvertent operation of water dispenser 14 by an individual bumping actuator 16 with the back of their hand while operating the adjacent ice dispenser 13 or by an individual accidentally contacting the water dispenser actuator while standing near the refrigerator, an interlock means has been provided. Referring to FIG. 2, an interlock member 38 is slidably mounted on lower extension 21 of actuator 16. Interlock member 38 is gravity biased downwardly against glass receiving portion 22. An abutment 42 protrudes forwardly from back surface 18 of housing 12 in general alignment with actuator 16. When interlock member 38 is in its normal rest position against glass receiving portion 22, a rear wall 40 thereof will strike abutment 42. When rear wall 40 of the interlock member strikes abutment 42, actuator 16 cannot be rotated a sufficient angular distance for pad 26 to actuate operator 28 of switch 30. Therefore, with interlock member 38 in its normal downward position, an inward force placed on glass receiving portion 22 will not operate the water dispenser.

FIG. 3 shows water dispenser 14 activated by a drinking glass 44. With a glass 44 pressed against glass receiving portion 22 by a user, an upper lip 45 of the glass contacts lower lip 46 of interlock member 38. The generally rearward and upward thrust of glass 44 pressed against glass receiving portion 22 will exert an upwardly directed force against interlock member 38 moving it upwardly along actuator 16. With interlock member 38 in its upwardly displaced position, as depicted in FIG. 3, its rear wall 40 will no longer strike abutment 42 as actuator 16 is rotated. With the interlock means thus disengaged, actuator 16 can be rotated a sufficient angular distance for pad 26 to operate switch 30. Abutment 42 will, however, limit the travel of actuator 16 sufficiently to prevent damage to switch 30 from overtravel of pad 26.

Figure 4:
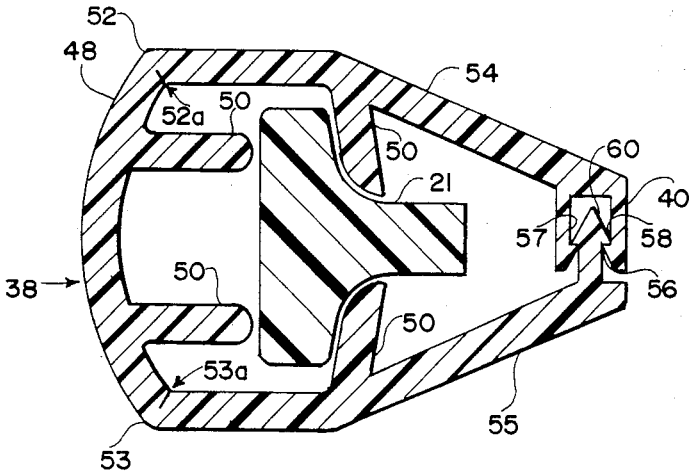
FIG. 4 is a cross section of the interlock member taken along the line 4—4 of FIG. 2.

Referring to FIG. 4, interlock member 38 is generally a sleeve having a polygonal peripheral wall 48 and several inwardly extending fingers 50 integrally formed with wall 48. Fingers 50 come into loose contact with the surface of lower extension 21 of actuator 16 to provide a low friction bearing between the interlock member and the actuator to ensure easy sliding movement of the interlock member along the actuator. In addition, fingers 50 space the peripheral wall 48 a sufficient distance rearwardly from lower extension 21 so as to position rear wall 40 to contact abutment 42 before actuator 16 has travelled a distance sufficient to operate switch 30, with the interlock member in its downward position. Further, fingers 50 space the peripheral wall 48 forward of lower extension 21 a sufficient distance to provide a large overhang to ensure a drinking glass will contact lower lip 46 of the interlock member to move the member upwardly.

Interlock member 38 is made from a resilient, plastic material such as polypropylene or polyester, and can be produced either by injection molding or by extrusion. A pair of living hinges 52, 53 are formed in peripheral wall 48, by reducing the thickness of the wall at 52*a* and 53*a*, allowing sidewall portions 54, 55 to be pivoted outwardly in order to install the interlock member on, or remove it from, the lower extension 21. Rear wall 40 is separated at its mid portion by a clasp 56 comprising a pair of jaws 57, 58 and a bolt member 60. The arrow-shaped head of member 60 allows the clasp to be easily fastened to secure the interlock member on extension 21. A somewhat stronger force is needed to open the clasp in order to install it on or remove it from lower extension 21.

Thus the construction of interlock member 38 allows it to be installed to existing water dispensers as a field installation in response to requests from consumers. In addition, if a consumer finds the interlock member to not be desired, he or she can remove it from the water dispenser and discard it.

It is thus seen that the present invention comprehends a dispenser interlock member that is simple in structure and is disengaged by the general rearward and upward thrust of a drinking glass pressed against the actuator to allow dispensing as a normal incidence of using a glass to actuate the dispenser. The present invention further comprehends such an interlock member that can be easily assembled to or removed from the water dispenser without tools and without the need to disassemble the water dispenser.

Changes and modifications in the specifically described embodiment can be carried out without departing from the scope of the invention.

What is claimed is:

1. An interlock member for a liquid dispenser having a housing, an abutment fixedly mounted in said housing, an actuator laterally movable in said housing in a generally horizontal direction toward said abutment from a nondispensing position to a dispensing position, a spout in said housing above said actuator and valve means responsive to said actuator in said dispensing position for delivering water from said spout to a receptacle, said interlock member comprising:

a polygonally shaped peripheral wall surrounding said actuator, antifriction means extending inwardly said peripheral wall for ensuring easy sliding movement of the interlock member along said actuator in a generally vertical direction, said peripheral wall having an outer surface defining a contact portion spaced rearwardly from said anti-friction means, and said peripheral wall further having an edge defining a lower lip portion, whereby said contact wall portion will strike the abutment preventing the actuator moving to the dispensing position unless a drinking glass lip simultaneously engages the lower lip of the interlock member to vertically raise the contact wall portion above the height of the abutment.

2. The interlock member of claim 1 wherein said antifriction means are inwardly extending fingers.

3. The interlock member of claim 1 wherein said peripheral wall has edge means defining a separable portion thereof.

4. The interlock member of claim 3 wherein said separable portion of said peripheral wall coincides with said contact portion of said wall.

5. The interlock member of claim 3 wherein said peripheral wall further defines clasp means at the separable portion thereof for releasably securing said perimeter wall.

6. The interlock member of claim 5 further having hinge means on said peripheral wall generally opposite said clasp means.

7. The interlock member of claim 6 wherein said hinge means is a reduction in the thickness of said peripheral wall defining a living hinge.

8. The interlock member of claim 6 wherein said hinge means defines a pair of hinges.

9. The interlock member of claim 5 wherein said clasp means comprises a pair of jaws defining a first portion thereof and a bolt member releasable received between said jaws defining a second portion thereof.

10. A liquid dispenser comprising:

a housing;

a dispensing spout mounted to said housing;

a valve connected to said spout by a liquid tube;

an actuator mounted to said housing and operatively connected to said valve to open said valve delivering liquid to said spout when displaced from a nondispensing position to a dispensing position, said actuator generally elongated in one axis and having an expanded end portion defining a glass receiving portion, said glass receiving portion traversing a predetermined distance generally perpendicular said one axis when said actuator is displaced from said nondispensing position to said dispensing position;

an abutment mounted to said housing adjacent said glass receiving portion;

an interlock member mounted to said actuator and slidable along said one axis thereof between a first position proximate said glass receiving portion and a second position spaced from said glass receiving portion;

biasing means biasing said interlock member toward said first position;

said interlock member defining a surface adjacent said abutment that will contact said abutment to prevent said glass receiving portion from traversing said predetermined distance to said dispersing position with said interlock member in said first position;

wherein said interlock member surface will not contact said abutment with said interlock member in said second position, allowing said glass receiving portion to traverse said predetermined distance to said dispensing position; and lip means on said interlock member for moving said interlock member to said second position as an incident of a drinking glass applying a force to said glass receiving portion.

11. The liquid dispenser of claim 10 wherein said biasing means is the force of gravity.

12. The liquid dispenser of claim 10 wherein said interlock member surrounds said actuator.

13. The liquid dispenser of claim 12 wherein said interlock member is a sleeve and said lip means is an edge of said sleeve proximate said glass receiving portion.

14. The liquid dispenser of claim 12 wherein said interlock member is a resilient sleeve with a separable portion to allow said interlock member to be installed on or removed from an actuator.

15. The liquid dispenser of claim 10 having antifriction means between said interlock member and said actuator.

16. The liquid dispenser of claim 10 wherein said abutment is molded integrally with said housing.

* * * * *